US009824844B2

(12) United States Patent
Nagata et al.

(10) Patent No.: US 9,824,844 B2
(45) Date of Patent: Nov. 21, 2017

(54) TRANSMISSION MODE PHOTOCATHODE

(71) Applicant: HAMAMATSU PHOTONICS K.K., Hamamatsu-shi, Shizuoka (JP)

(72) Inventors: Takaaki Nagata, Hamamatsu (JP); Yasumasa Hamana, Hamamatsu (JP); Kimitsugu Nakamura, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/029,336

(22) PCT Filed: Aug. 8, 2014

(86) PCT No.: PCT/JP2014/071089
§ 371 (c)(1),
(2) Date: Apr. 14, 2016

(87) PCT Pub. No.: WO2015/064173
PCT Pub. Date: May 7, 2015

(65) Prior Publication Data

US 2016/0233044 A1 Aug. 11, 2016

(30) Foreign Application Priority Data

Nov. 1, 2013 (JP) ..... 2013-228044

(51) Int. Cl.
*H01J 1/34* (2006.01)
*H01J 1/32* (2006.01)
(Continued)

(52) U.S. Cl.
CPC *H01J 1/34* (2013.01); *H01J 1/32* (2013.01); *H01J 40/06* (2013.01); *H01J 43/08* (2013.01); *H01J 43/10* (2013.01)

(58) Field of Classification Search
CPC ..... H01J 1/34; H01J 1/32; H01J 43/10; H01J 43/08; H01J 40/06
See application file for complete search history.

(56) References Cited

U.S. PATENT DOCUMENTS 6,670,752 B2 12/2003 Kinoshita et al.
8,796,923 B2 8/2014 Matsui et al.
(Continued)

FOREIGN PATENT DOCUMENTS

CN 1945776 4/2007
CN 203551109 4/2014
(Continued)

OTHER PUBLICATIONS

International Preliminary Report on Patentability dated May 3, 2016 for PCT/JP2014/071089.
(Continued)

*Primary Examiner* — Donald Raleigh
*Assistant Examiner* — Kevin Quarterman
(74) *Attorney, Agent, or Firm* — Drinker Biddle & Reath LLP

(57) ABSTRACT

A transmission mode photocathode comprises: an optically transparent substrate having an outside face to which light is incident, and an inside face from which the light incident to the outside face side is output; a photoelectric conversion layer disposed on the inside face side of the optically transparent substrate and configured to convert the light output from the inside face into a photoelectron or photoelectrons; and an optically-transparent electroconductive layer comprising graphene, and disposed between the optically transparent substrate and the photoelectric conversion layer.

18 Claims, 9 Drawing Sheets

(51) Int. Cl.

| | |
|---|---|
| ***H01J 40/06*** | (2006.01) |
| ***H01J 43/08*** | (2006.01) |
| ***H01J 43/10*** | (2006.01) |

(56) References Cited

U.S. PATENT DOCUMENTS

| | | | | |
|---|---|---|---|---|
| 2003/0001497 | A1 | 1/2003 | Kinoshita et al. | |
| 2008/0121928 | A1* | 5/2008 | Niigaki | H01L 31/0735 257/184 |
| 2013/0082241 | A1* | 4/2013 | Kub | H01L 27/148 257/21 |
| 2013/0134869 | A1 | 5/2013 | Nützel et al. | |
| 2013/0293100 | A1 | 11/2013 | Moody | |

FOREIGN PATENT DOCUMENTS

| | | | |
|---|---|---|---|
| JP | H03-108244 | A | 5/1991 |
| JP | 2598730 | B2 | 4/1997 |
| JP | 2001-202873 | A | 7/2001 |
| JP | 2003-203581 | | 7/2003 |
| JP | 2005-203280 | A | 7/2005 |
| JP | 2005-339844 | A | 12/2005 |
| JP | 2007-042559 | A | 2/2007 |
| JP | 2013-016509 | A | 1/2013 |
| JP | 2013-522821 | A | 6/2013 |
| WO | WO 03/107386 | | 12/2003 |

OTHER PUBLICATIONS

Zhouying Zhao et al., "Enhanced ultraviolet response using graphene electrodes in organic solar cells", Applied Physics Letters, AIP Publishing LLC, US, vol. 101, No. 6, Aug. 6, 2012, p. 63305, XP012164346.

A. Braem et al., "Development of a 10-inch HPD with integrated readout electronics", Nuclear Instruments & Methods in Physics Research, Section A: Accelerators, Spectrometers, Detectors, and Associated Equipment, Elsevier BV, North-Holland, NL, vol. 504, No. 1-3, May 21, 2003, p. 19-p. 23, XP004426176.

Sukanta DE et al., "Are There Fundamental Limitations on the Sheet Resistance and Transmittance of Thin Graphene Films?", ACS Nano, vol. 4, No. 5, May 25, 2010, p. 2713-p. 2720, XP055298720.

* cited by examiner (a)

(b)

TRANSMISSION MODE PHOTOCATHODE

TECHNICAL FIELD

The present invention relates to a transmission mode photocathode.

BACKGROUND ART

The transmission mode photocathode is desired to perform detection with linearity in a wide range of small to large light quantities, or, to improve its cathode linearity characteristic. The cathode linearity characteristic herein means linearity of cathode output current against incident light quantity. For improving the cathode linearity characteristic, it is necessary to implement appropriate charge supply to a photoelectric conversion layer and it can be considered that the necessity is met, for example, by placing an electroconductive layer (underlying layer) between an optically transparent substrate and the photoelectric conversion layer to reduce the surface resistance of the photoelectric conversion layer.

On the other hand, for a reflection photocathode, there is a known configuration wherein a layer of graphite and carbon nanotube or the like (intermediate layer) is placed between a substrate and a photoelectric surface (cf. Patent Literature 1 below).

CITATION LIST

Patent Literature

Patent Literature 1: Japanese Unexamined Patent Publication No. 2001-202873

SUMMARY OF INVENTION

Technical Problem

However, such an intermediate layer absorbs a considerable amount of incident light in certain cases; for this reason, when it was applied to the transmission photoelectric surface, the quantity of light reaching the photoelectric conversion layer sometimes became insufficient, resulting in failure in detection with sufficient sensitivity. On the other hand, it is also possible to add an additive to the photoelectric conversion layer so as to reduce the surface resistance of the photoelectric conversion layer itself, thereby achieving appropriate charge supply to the photoelectric conversion layer, but the addition of the additive could lower a quantum efficiency of the photoelectric conversion layer, also resulting in failure in obtaining sufficient sensitivity. As described above, the transmission photoelectric surface had the problem that the attempt to improve the cathode linearity characteristic by reduction in surface resistance of the photoelectric conversion layer led to degradation of sensitivity at the same time.

The present invention has been accomplished in view of the above problem and it is an object of the present invention to provide a transmission mode photocathode capable of achieving an improvement in cathode linearity characteristic, while maintaining sufficient sensitivity.

Solution to Problem

A transmission mode photocathode according to one aspect of the present invention comprises: an optically transparent substrate having one face to which light is incident, and another face from which the light incident to the one face is output; a photoelectric conversion layer disposed on the other face side of the optically transparent substrate and configured to convert the light output from the other face into a photoelectron or photoelectrons; and an optically-transparent electroconductive layer comprising graphene, and disposed between the optically transparent substrate and the photoelectric conversion layer.

The transmission mode photocathode according to the one aspect of the present invention can reduce the surface resistance of the photoelectric conversion layer without impeding incidence of light to the photoelectric conversion layer because the optically-transparent electroconductive layer comprising graphene with high optical transparency and high electrical conductivity is disposed between the optically transparent substrate and the photoelectric conversion layer. This can achieve an improvement in cathode linearity characteristic, while maintaining sufficient sensitivity.

In the transmission mode photocathode, the optically-transparent electroconductive layer may be comprised of a single layer of graphene. When the optically-transparent electroconductive layer is formed of a single layer of graphene in this manner, the optical transmittance of the optically-transparent electroconductive layer can be made higher than in a case where the optically-transparent electroconductive layer is formed of multiple layers of graphene. This allows the light output from the other face of the optically transparent substrate to be more certainly guided to the photoelectric conversion layer, so as to more enhance the sensitivity.

In the transmission mode photocathode, the optically-transparent electroconductive layer may be comprised of multiple layers of graphene. When the optically-transparent electroconductive layer is formed of a stack of multiple layers of graphene with high electrical conductivity in this manner, the surface resistance of the photoelectric conversion layer can be reduced more certainly, so as to more improve the cathode linearity characteristic.

Advantageous Effects of Invention

The present invention has achieved the improvement in cathode linearity characteristic, while maintaining the sufficient sensitivity.

DESCRIPTION OF EMBODIMENTS

Figure 1:
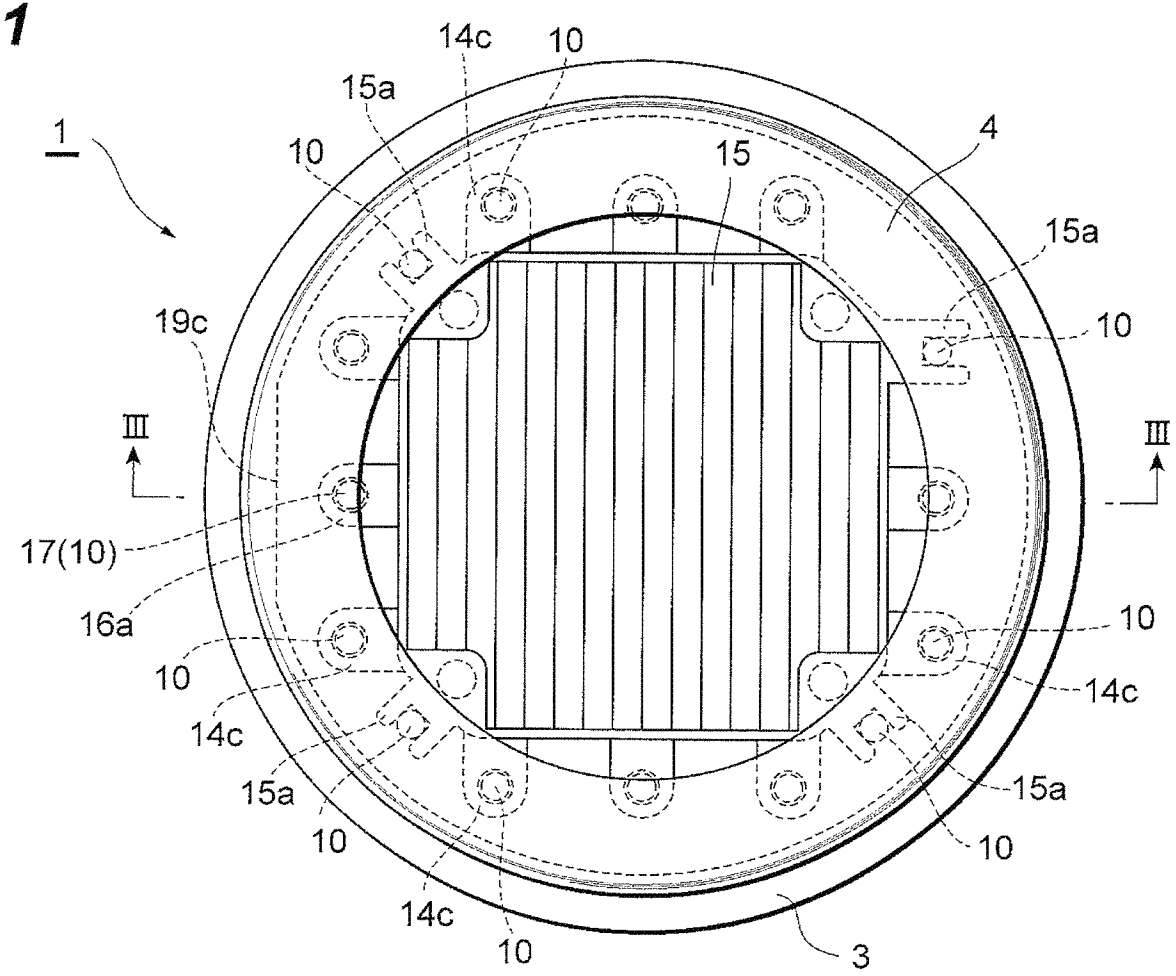
FIG. 1 is a plan view showing a photomultiplier tube using a transmission mode photocathode according to one embodiment of the present invention.

An embodiment of the transmission mode photocathode according to the present invention will be described below with reference to the drawings. It should be noted that the terms "upper," "lower," etc. in the description hereinbelow are used for descriptive purposes based on the states shown in the drawings. Throughout the drawings identical or equivalent portions are denoted by the same reference signs, while avoiding redundant description. The drawings include emphasized portions in part in order to facilitate understanding of the description of the features of the present invention, which are different in size from actual corresponding portions. The present embodiment will be described with an example of transmission mode photocathode 2 which is used as a photocathode of a transmission type in a photomultiplier tube 1.

Figure 2:
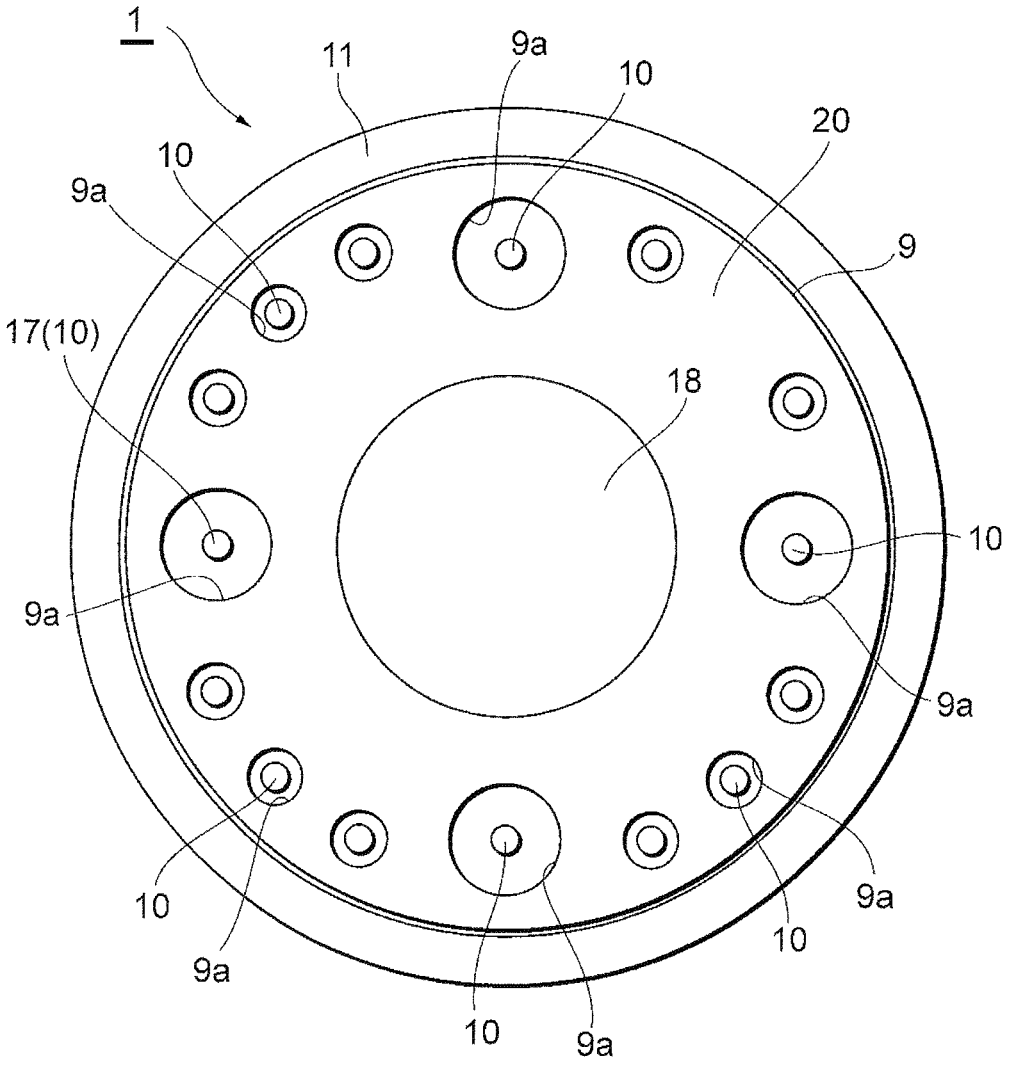
FIG. 2 is a bottom view of the photomultiplier tube shown in FIG. 1.
Figure 3:
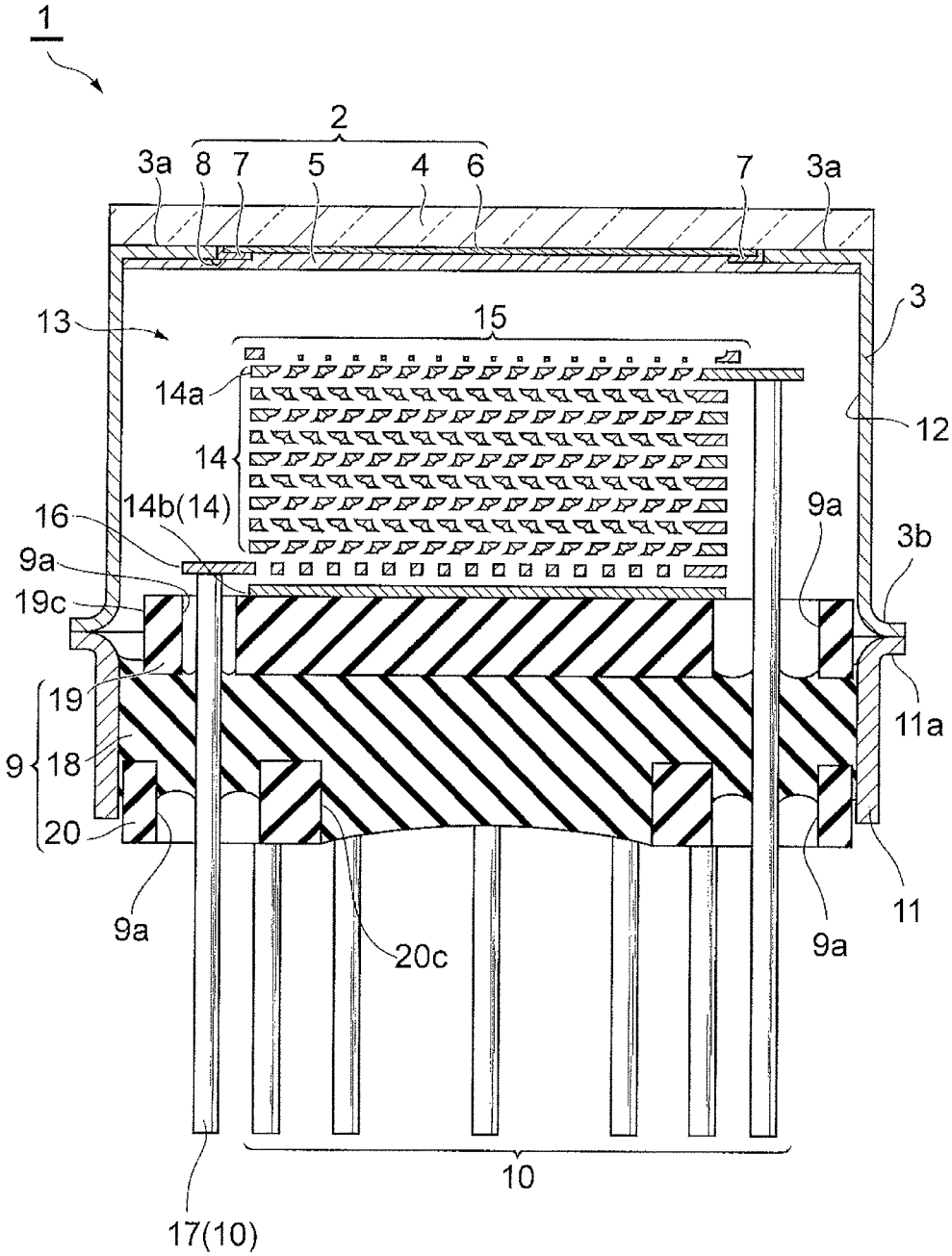
FIG. 3 is a cross-sectional view along the line III-III in FIG. 1.

As shown in FIG. 1 to FIG. 3, the photomultiplier tube 1 being an electron tube has a side tube 3 made of metal in a substantially cylindrical shape. As shown in FIG. 3, a flange portion 3*a* extending inward is formed at the upper end of the cylindrical side tube 3. An optically transparent substrate 4 with optical transparency is hermetically fixed to this flange portion 3*a* while being kept in contact therewith. On the side where an inside face (other face) 4*b* of the optically transparent substrate 4 lies, a photoelectric conversion layer 5 is formed through an optically-transparent electroconductive layer 6 with optical transparency and, a contact portion 7 comprised of an electroconductive material. The photoelectric conversion layer 5 converts light incident thereto through the optically transparent substrate 4 into a photoelectron or photoelectrons. The contact portion 7 and the side tube 3 are electrically connected by a bonding wire 8. The transmission mode photocathode 2 of the present embodiment is composed of the optically transparent substrate 4, optically-transparent electroconductive layer 6, contact portion 7, and bonding wire 8. The details of the configuration of the transmission mode photocathode 2 will be described after description of the overall configuration of the photomultiplier tube 1.

As shown in FIG. 2 and FIG. 3, a stem 9 of a circular disk shape is disposed at the lower opening end of the side tube 3. A plurality of (fifteen) electroconductive stem pins 10, which are disposed at respective positions along a substantially circular shape while circumferentially separated from each other, are hermetically arranged so as to penetrate through this stem 9. A ring-shaped side tube 11 made of metal is hermetically fixed to this stem 9 so as to surround it from its side. A flange portion 3*b* formed at the lower end of the upper side tube 3 and a flange portion 11*a* with the same diameter formed at the upper end of the lower ring-shaped side tube 11 are welded, as shown in FIG. 3, whereby the side tube 3 and the ring-shaped side tube 11 are hermetically fixed to each other. In this configuration, a hermetic vessel 12 is formed as composed of the side tube 3, optically transparent substrate 4, and stem 9, while the inside thereof is maintained in a vacuum state.

An electron multiplication unit 13 for multiplying the photoelectrons emitted from the photoelectric conversion layer 5 is housed in the hermetic vessel 12 formed as described above. This electron multiplication unit 13 is configured in a block form by stacking multiple stages (ten stages in the present embodiment) of dynode plates 14 of a thin plate shape having a large number of electron multiplication holes with secondary electron faces, and is installed on the top surface of the stem 9. A dynode plate connection piece 14*c* projecting outward is formed, as shown in FIG. 1, at a predetermined edge of each dynode plate 14. A tip portion of a predetermined stem pin 10 penetrating through the stem 9 is fixed as welded to the lower face side of each dynode plate connection piece 14*c*. This establishes electrical connection between each dynode plate 14 and each stem pin 10.

Furthermore, as shown in FIG. 3, a focusing electrode 15 of a flat plate shape for guiding the photoelectrons emitted from the photoelectric conversion layer 5, to the electron multiplication unit 13 while focusing them is installed between the electron multiplication unit 13 and the photoelectric conversion layer 5 in the hermetic vessel 12. An anode (positive electrode) 16 of a flat plate shape for extracting as output signal, secondary electrons emitted from the final-stage dynode 14*b* through multiplication by the electron multiplication unit 13 is arranged as laminated at a stage one step up the final-stage dynode 14*b*. As shown in FIG. 1, projection pieces 15*a* projecting outward are formed respectively at the four corners of the focusing electrode 15. A predetermined stem pin 10 is fixed as welded to each of the projection pieces 15*a*, thereby establishing electrical connection between the stem pins 10 and the focusing electrode 15. An anode connection piece 16*a* projecting outward is also formed at a predetermined edge of the anode 16. An anode pin 17, which is one of the stem pins 10, is fixed as welded to this anode connection piece 16*a*, thereby establishing electrical connection between the anode pin 17 and anode 16. When a predetermined voltage is applied to the electron multiplication unit 13 and the anode 16 through the stem pins 10 connected to an unillustrated power supply circuit, the photoelectric conversion layer 5 and focusing electrode 15 are set at the same potential and the dynode plates 14 are set at respective potentials so as to become higher in the stacked order from top to bottom. The anode 16 is set at a higher potential than the final-stage dynode plate 14*b*.

As shown in FIG. 3, the stem 9 has a three-layer structure consisting of a base member 18, an upper retainer 19 joined to the top (inside) of the base member 18, and a lower retainer 20 joined to the bottom (outside) of the base member 18, and the aforementioned ring-shaped side tube 11 is fixed to the side face thereof. In the present embodiment, the side face of the base member 18 forming the stem 9 is joined to the inner wall surface of the ring-shaped side tube 11, whereby the stem 9 is fixed to the ring-shaped side tube 11.

Figure 4:
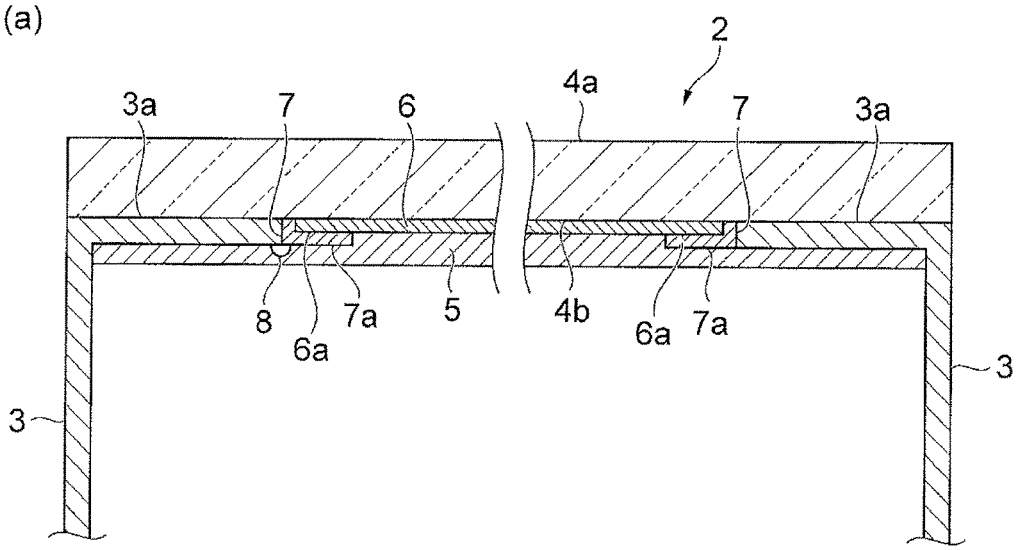
FIG. 4 is a drawing schematically showing the transmission mode photocathode, wherein (a) is a schematic side sectional view of the transmission mode photocathode and (b) is a schematic plan view of the transmission mode photocathode.
Figure 4:
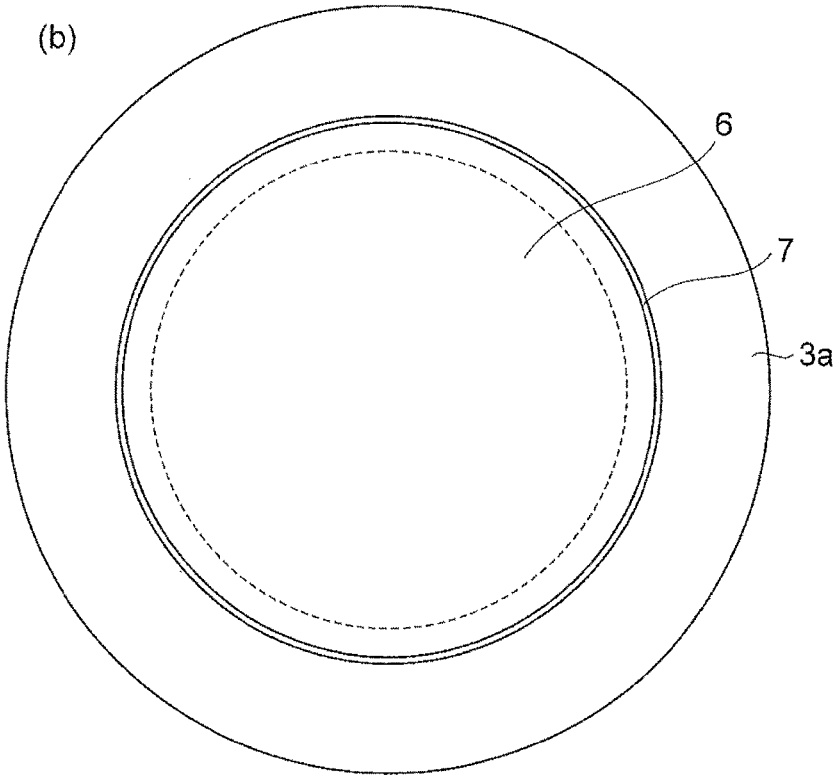

The transmission mode photocathode 2 will be described using FIG. 4. FIG. 4(*a*) is a schematic side sectional view of the transmission mode photocathode 2. FIG. 4(*b*) is a schematic plan view of the transmission mode photocathode 2 viewed from the side where the optically transparent substrate 4 is disposed. However, illustration of the optically transparent substrate 4 is omitted in FIG. 4(*b*).

As described above, the optically transparent substrate 4, which has good optical transparency to light of wavelengths to be detected by the photoelectric conversion layer 5, e.g., ultraviolet light, is provided in the circular disk shape on the top face of the upper flange portion 3*a* of the side tube 3. The optically transparent substrate 4 is, for example, a faceplate comprised of glass such as quartz. The optically transparent substrate 4 has an outside face (one face) 4*a* to which light is incident, and an inside face 4*b* provided opposite to the outside face 4*a* with respect to the main body of the substrate. The light incident from the outside face 4*a* side passes through the interior of the substrate main body to be output from the inside face 4*b*.

The optically-transparent electroconductive layer 6 comprised of graphene is formed as separated from the edge of the flange portion 3*a*, on the surface of a circular region out of contact with the flange portion 3*a* on the inside face 4*b* of the optically transparent substrate 4. Furthermore, the contact portion 7 comprised of an electroconductive material (e.g., aluminum (Al)) is formed in an annular shape as kept in contact with the flange portion 3*a* so as to be interposed between the optically-transparent electroconductive layer 6 and the edge of the flange portion 3*a* and as covering the edge portion 6*a* of the optically-transparent electroconductive layer 6, in order to establish electrical connection between the optically-transparent electroconductive layer 6 and the flange portion 3*a* (metal side tube 3). As the contact portion 7 is formed in this configuration, the side tube 3 can be securely electrically connected through the contact portion 7 to the optically-transparent electroconductive layer 6 and the photoelectric conversion layer 5. It is noted that the contact portion 7 may be formed so as to extend up onto the lower face of the flange portion 3*a*.

Furthermore, in the present embodiment, the bonding wire 8, one end of which is connected to the lower face 7*a* of the contact portion 7 and the other end of which is connected to the lower face of the flange portion 3*a*, is provided, thereby establishing securer electrical connection of the side tube 3 to the optically-transparent electroconductive layer 6 and the photoelectric conversion layer 5.

The photoelectric conversion layer 5 is formed so as to cover the lower face of the flange portion 3*a*, the contact portion 7, and the lower face of the optically-transparent electroconductive layer 6. The photoelectric conversion layer 5 converts the light output from the inside face 4*b* of the optically transparent substrate 4 into a photoelectron or photoelectrons. The photoelectric conversion layer 5 is configured, for example, so as to contain antimony (Sb), potassium (K), and cesium (Cs), or the like.

Figure 5:
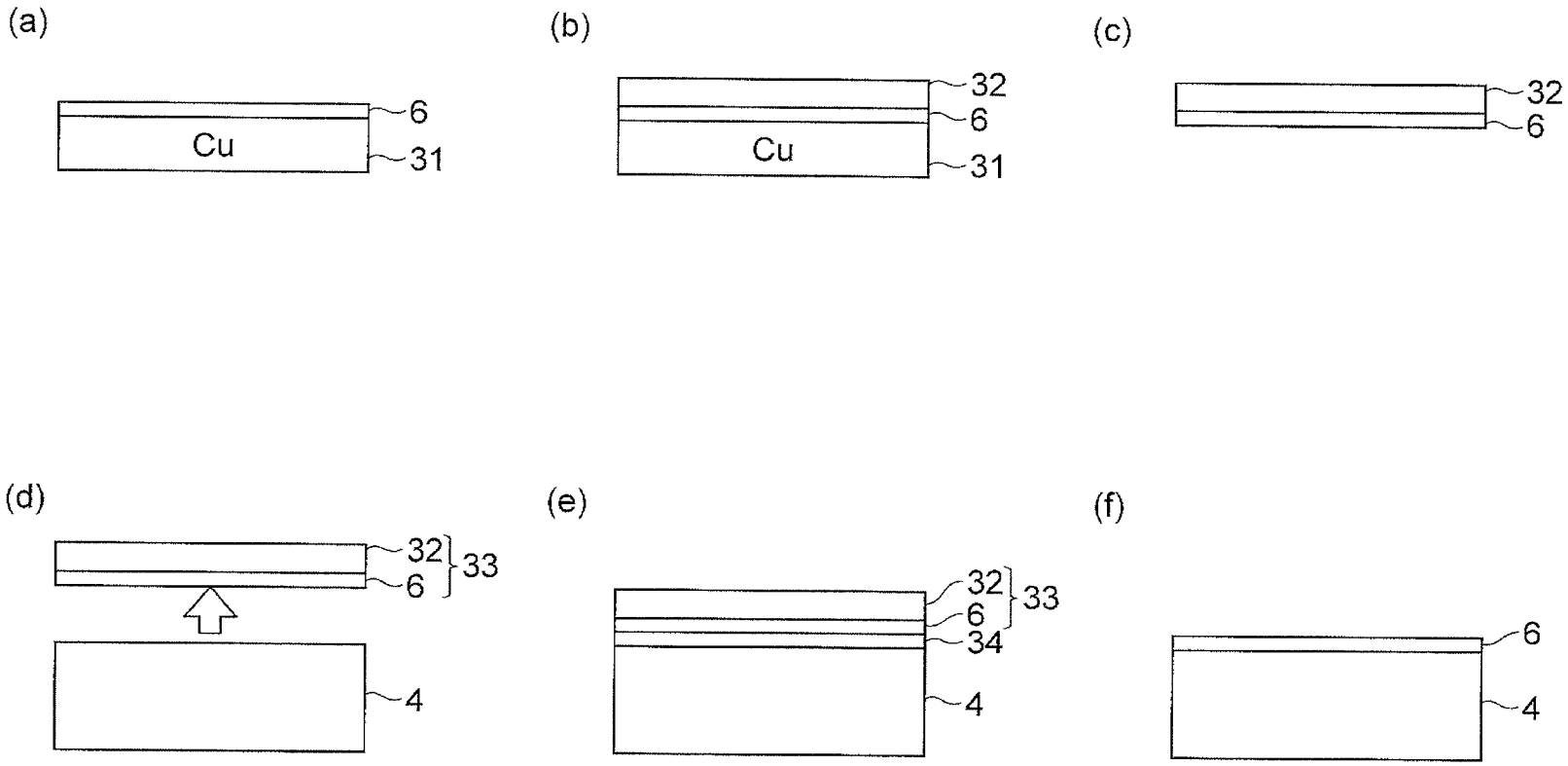
FIG. 5 is a schematic view for explaining a method for manufacturing the transmission mode photocathode according to the embodiment.

The below will describe an example of a method for manufacturing the above-described transmission mode photocathode 2. First, the optically transparent substrate 4 is prepared and the optically-transparent electroconductive layer 6 comprised of graphene is deposited on the surface of this optically transparent substrate 4. A method of this deposition will be described below in detail. First, a layer of graphene is formed on the surface of copper foil 31 by a thermal CVD method. For example, the copper foil is placed under high pressure and high temperature of 1000 Pa and about 1000° C. and methane ($CH_4$) and hydrogen ($H_2$) are supplied thereto at a ratio of 9:1 (e.g., $CH_4$=450 sccm and $H_2$=50 sccm), to form a graphene layer (optically-transparent electroconductive layer 6) on the surface of the copper foil 31 (cf. FIG. 5(*a*)). Subsequently, PMMA (polymethylmethacrylate resin) is applied to the surface of the optically-transparent electroconductive layer 6 to form a resin layer 32 (cf. FIG. 5(*b*)). Thereafter, the copper foil 31 is removed by etching (cf. FIG. 5(*c*)). Then, the film 33 consisting of the optically-transparent electroconductive layer 6 and resin layer 32 obtained as described above is made to float on water and thereafter this film 33 is scooped up by the optically transparent substrate 4 (cf. FIG. 5(*d*)). After that, water 34 remaining between the film 33 and the optically transparent substrate 4 is vaporized by drying (cf. FIG. 5(*e*)). Finally, the resin layer 32 is removed with acetone to obtain the optically transparent substrate 4 on which the optically-transparent electroconductive layer 6 is formed in a desired region (central region) on the surface (inside face 4*b*).

Next, the inside face 4*b* of the optically transparent substrate 4 is hermetically fixed to the flange portion 3*a* of the side tube 3 so that the flange portion 3*a* of the side tube 3 surrounds the optically-transparent electroconductive layer 6 as separated therefrom. Subsequently, from the inside of the side tube 3, aluminum (Al) is evaporated in an annular shape so as to cover the gap between the optically-transparent electroconductive layer 6 and the flange portion 3*a* and cover the edge portion 6*a* of the optically-transparent electroconductive layer 6, thereby to form the contact portion. 7. Then, the lower face 7*a* of the contact portion 7 and the lower face of the flange portion 3*a* of the side tube 3 are electrically connected by the bonding wire 8. Next, from the inside of the side tube 3, antimony (Sb) is evaporated onto the lower face of the flange portion 3*a*, the contact portion 7, and the lower face of the optically-transparent electroconductive layer 6. Furthermore, potassium (K) and cesium (Cs) are made to react with antimony (Sb) by means of a transfer device to form a bialkali photoelectric surface (photoelectric conversion layer 5). Thereafter, the flange portion 11*a* of the ring-shaped side tube 11 to which the stem 9 with the electron multiplication unit 13 installed thereon is hermetically fixed is welded to the flange portion 3*b* of the side tube 3, thereby forming the hermetic vessel 12. It is also possible to preliminarily hermetically fix the inside face 4*b* of the optically transparent substrate 4 to the flange portion 3*a* of the side tube 3 and then form the optically-transparent electroconductive layer 6 on the inside face 4*b* of the optically transparent substrate 4.

Figure 6:
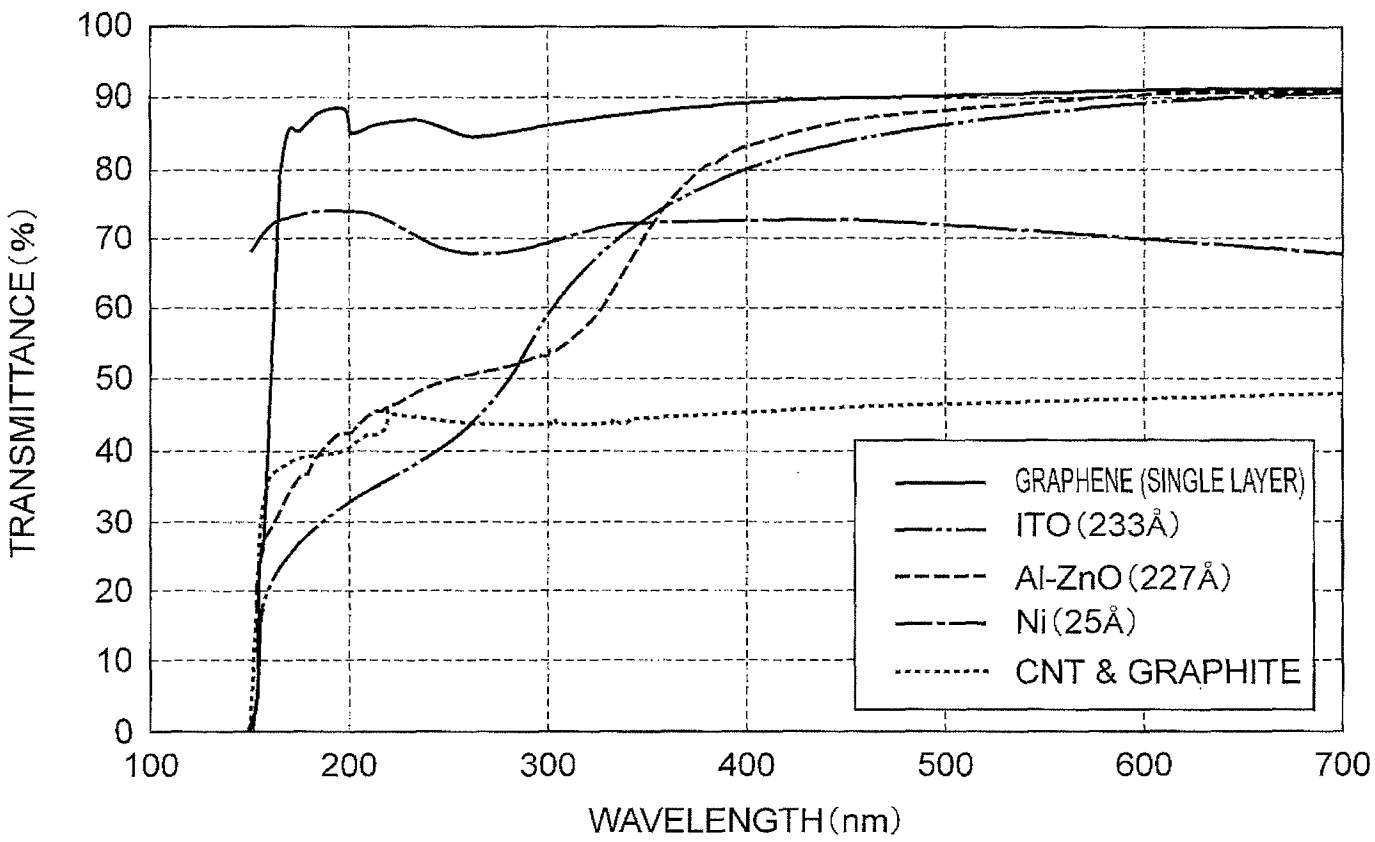
FIG. 6 is a graph showing the measurement results of optical transmittances of graphene and other electroconductive materials.
Figure 7:
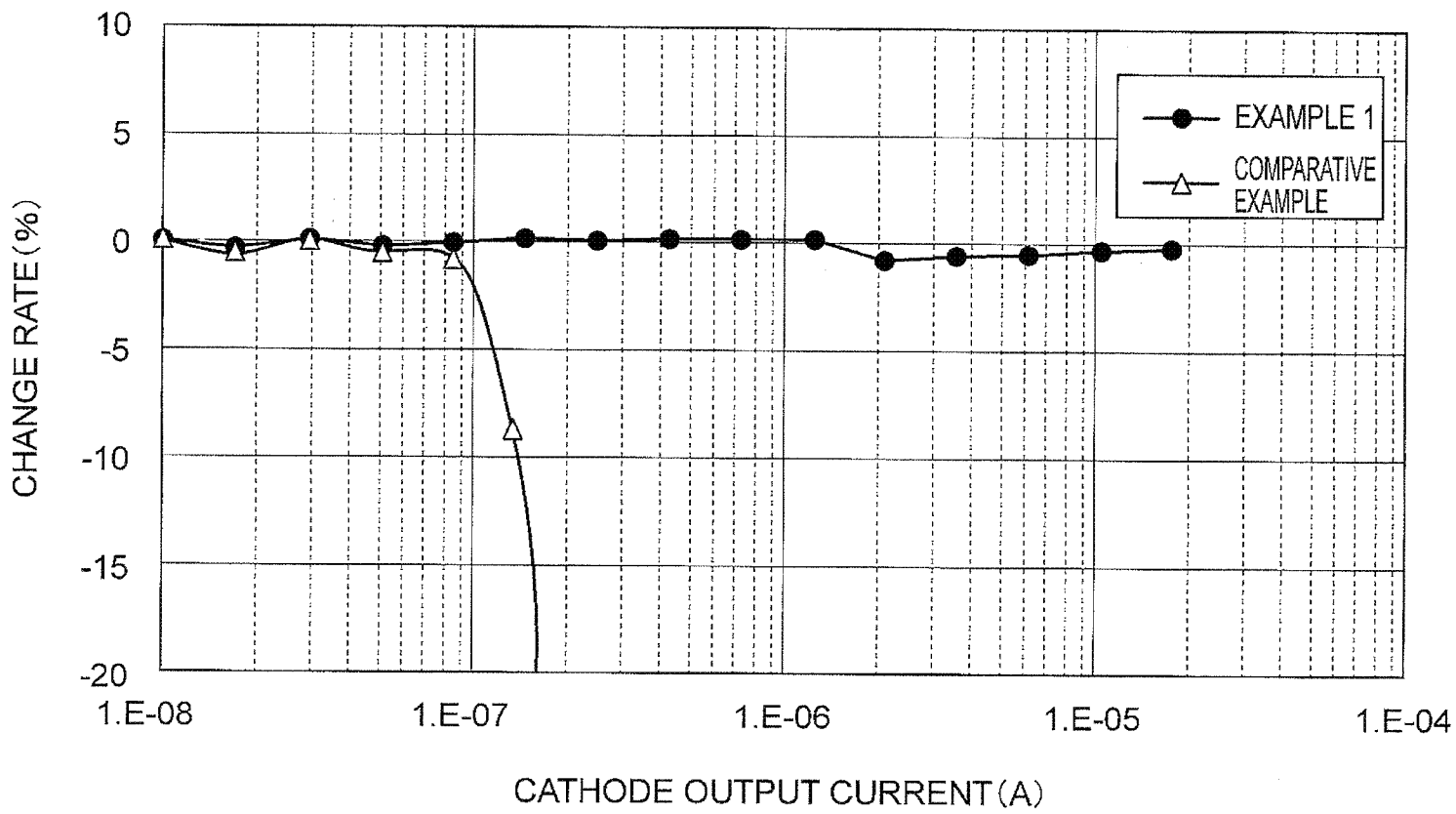
FIG. 7 is a graph showing the cathode linearity measurement results of the transmission mode photocathode according to Example 1 and a comparative photocathode.

The following will describe the superiority of use of the optically-transparent electroconductive layer 6 comprised of graphene as an underlayer for the photoelectric conversion layer 5, using FIGS. 6 and 7. The graph of FIG. 6 shows the measurement results of spectral transmittances of respective cases where graphene is used and where carbon, nanotube (CNT) mixed with graphite is used, as an underlayer for the photoelectric conversion layer 5. The graph of FIG. 6 also shows the spectral transmittances of transparent electroconductive film materials used in electron tubes for reference. The transparent electroconductive film materials herein are indium tin oxide (ITO), aluminum-added zinc oxide (Al—ZnO), and nickel (Ni).

A sample of CNT mixed with graphite is one prepared by a procedure as described in 1 to 6 below.

1. Mixed powder of CNT and graphite is solved in alcohol and stirred.

2. The mixture is kept still until graphite flakes are precipitated.

3. A supernatant solution is collected.

4. A sample substrate (Φ1-inch quartz plate) is heated to 200° C. by a heater.

5. A drop of the supernatant solution collected in 3 is placed onto the quartz plate with a pipette.

6. 5 is executed again after evaporation of alcohol is confirmed.

As shown in FIG. 6, CNT mixed with graphite used as a conventional underlayer has lower transmittances overall across a wide wavelength range than graphene and the difference thereof from graphene is prominent, particularly, in the range from ultraviolet light to visible light. For this reason, it can be said that graphene with higher optical transparency than conventional CNT mixed with graphite is suitable, particularly, as an underlayer for the photoelectric conversion layer 5 with sensitivity to the range from ultraviolet light to visible light. Furthermore, ITO and Al—ZnO have lower transmittances in the ultraviolet region than graphene and Ni has lower transmittances overall than graphene. In this manner, graphene has the higher optical transparency across the wide wavelength range, particularly, from ultraviolet light to visible light, not only than CNT mixed with graphite used conventionally as an underlying layer, but also than the other electroconductive materials. Therefore, the optically-transparent electroconductive layer 6 comprised of graphene can be said to be better suited for the underlayer for the photoelectric conversion layer 5 in the transmission mode photocathode 2.

FIG. 7 is a drawing showing the cathode linearity measurement results of the transmission mode photocathode 2 of the photomultiplier tube 1 (Example 1) according to the present embodiment, and a transmission mode photocathode of a photomultiplier tube (Comparative Example) without the underlayer (part corresponding to the optically-transparent electroconductive layer 6) for the photoelectric conversion layer. In the graph of FIG. 7 the axis of abscissa represents cathode output current values and the axis of ordinate does change rates indicative of degrees of deviation of cathode output current values from current values in an ideal linearity case (ideal values). Namely, linearity becomes better as the change rate becomes closer to 0%. The results obtained were as shown in FIG. 7: Comparative Example becomes off the standard of cathode linearity (within ±5%) at about 0.1 μA, whereas Example 1 remains within the standard even over 10 μA. Therefore, the optically-transparent electroconductive layer 6 comprised of graphene is said to be suitable as an underlayer for the photoelectric conversion layer 5 in the transmission mode photocathode 2, in terms of the cathode linearity characteristic as well.

Figure 8:
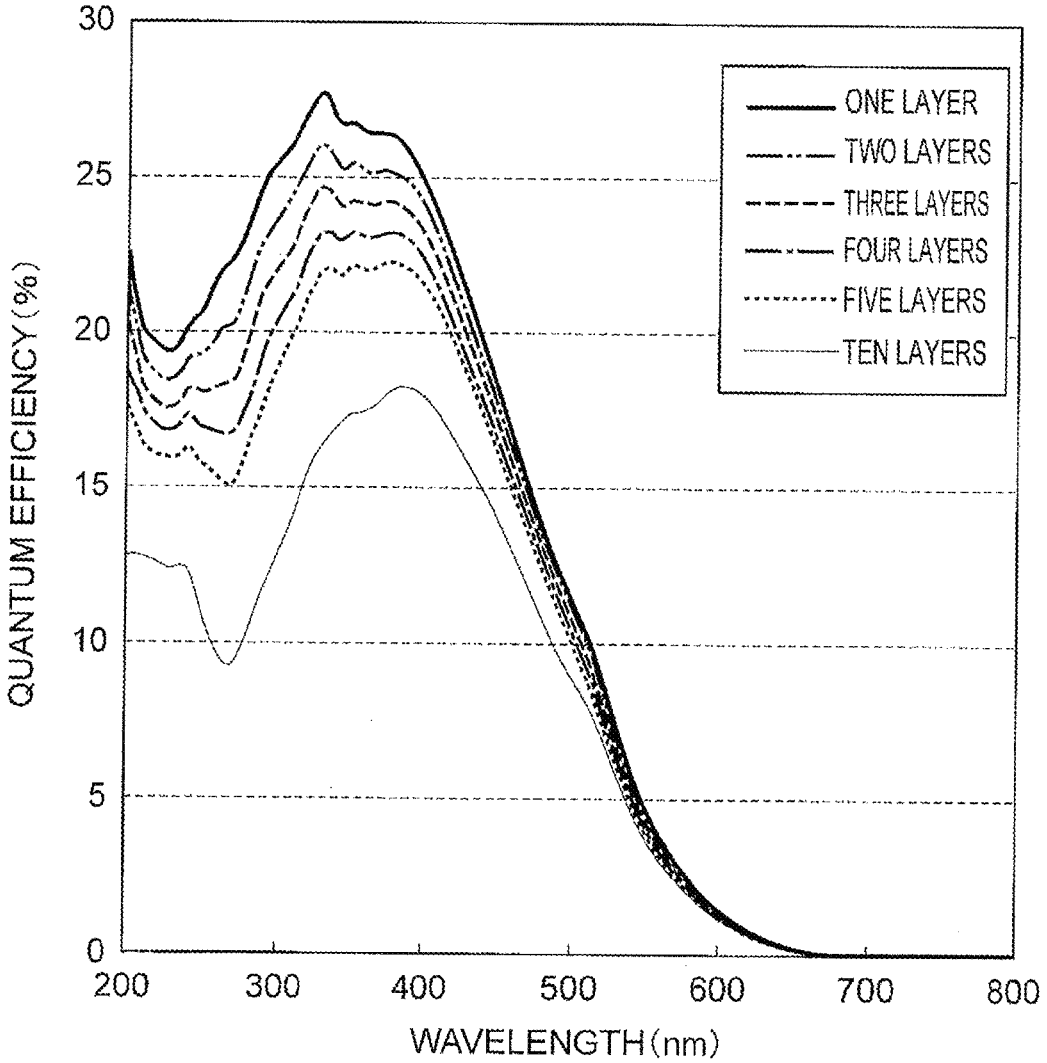
FIG. 8 is a graph showing estimations of quantum efficiencies with variation in the number of graphene layers of the optically-transparent electroconductive layer in the transmission mode photocathode according to Example 1.

FIG. 8 is a graph showing estimations of quantum efficiencies with variation in the number of graphene layers forming the optically-transparent electroconductive layer 6 in the transmission mode photocathode 2. As shown in FIG. 8, it is expected that, with increase in the number of graphene layers forming the optically-transparent electroconductive layer 6, the quantum efficiency decreases because of decrease in optical transmittance. Namely, the optical transmittance of the optically-transparent electroconductive layer 6 can be made higher when the optically-transparent electroconductive layer 6 is formed of a single layer (monolayer) of graphene than when the optically-transparent electroconductive layer 6 is formed of multiple layers of graphene. This allows the light output from the inside face 4*b* of the optically transparent substrate 4 to be more certainly guided to the photoelectric conversion layer 5, so as to increase the quantum efficiency and enhance the spectral sensitivity more.

On the other hand, as shown in FIG. 8, as long as the graphene layers forming the optically-transparent electroconductive layer 6 are a stack of only several layers, the decrease in quantum efficiency, or degradation of spectral sensitivity is restrained to some extent and thus we can expect that the transmission mode photocathode 2 has sufficient sensitivity. Therefore, the optically-transparent electroconductive layer 6 may be composed of multiple layers of graphene in situations such as a case where the light quantity is sufficient and the output current from the photomultiplier tube 1 is desired to be made large. In this case, the surface resistance of the photoelectric conversion layer 5 is reduced more certainly and the cathode linearity characteristic is more improved. When the number of graphene layers is a certain number (e.g., six or more), the optically transparent substrate 4 with the optically-transparent electroconductive layer 6 thereon can be readily manufactured by applying an ink-like material onto the inside face 4*b* of the optically transparent substrate 4.

Since the transmission mode photocathode 2 described above has the optically-transparent electroconductive layer 6 of graphene with high optical transparency and high electrical conductivity between the optically transparent substrate 4 and the photoelectric conversion layer 5, the surface resistance of the photoelectric conversion layer 5 can be reduced without impeding incidence of light to the photoelectric conversion layer 5. This can achieve the improvement in cathode linearity characteristic, while maintaining the sufficient sensitivity.

The present invention does not have to be limited only to the above-described embodiment. For example, the transmission mode photocathode according to the present invention can be used as a transmission mode photocathode, for example, in electron tubes such as phototubes, image intensifiers, streak tubes, and X-ray image intensifiers.

Figure 9:
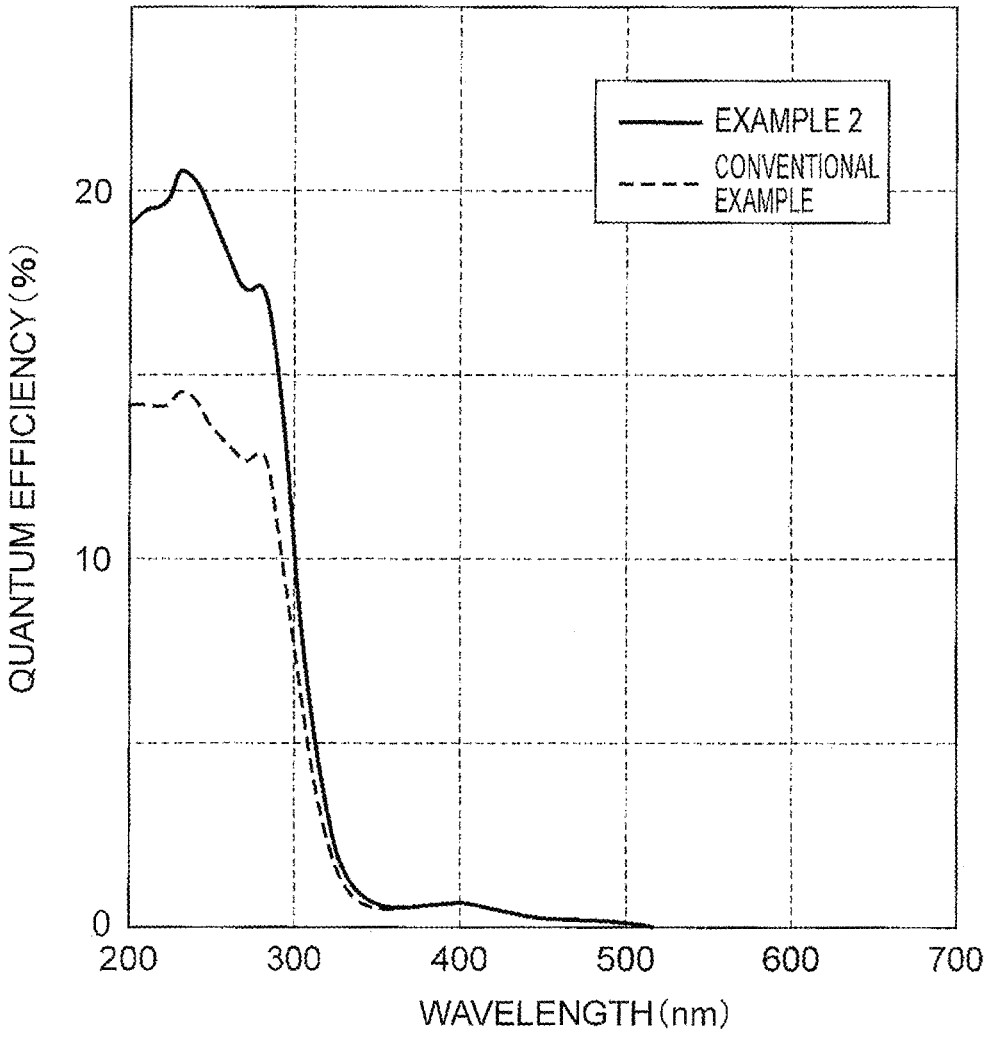
FIG. 9 is a drawing showing the quantum efficiency measurement results of the transmission mode photocathode according to Example 2 and a conventional photocathode.

The following will describe the fact that the transmission mode photocathode according to the present invention can also be suitably applied to the transmission mode photocathode of the image intensifier, with reference to FIG. 9. FIG. 9 is a drawing showing the measurement results of quantum efficiencies of an image intensifier with a CeTe photoelectric surface (photoelectric conversion layer) wherein the optically-transparent electroconductive layer consisting of a single layer of graphene is formed as an underlayer between the optically transparent substrate and the CeTe photoelectric surface (Example 2); and an image intensifier manufactured using a conventional metal (Ni) underlayer (Conventional Example). In comparison between quantum efficiencies at the wavelength of 280 nm, the quantum efficiency of Example 2 is 17.41%, whereas that of Conventional Example is 12.76%, thereby confirming the sensitivity improvement of about 1.36 times.

It is noted that the photoelectric conversion layer 5 does not have to be limited only to the one consisting primarily of the alkali metals, but may be one consisting of a semiconductor crystal containing gallium or the like. The optically transparent substrate 4, which does not have to be limited only to quartz, can also be selected from various optically transparent materials in accordance with conditions such as the wavelength range to be detected. Furthermore, the side tube 3 may also be comprised of an insulating material such as glass or ceramic, without having to be limited only to the electroconductive materials such as metal.

REFERENCE SIGNS LIST

1 photomultiplier tube; 2 transmission mode photocathode; 3 side tube; 4 optically transparent substrate; 4*a* outside face (one face); 4*b* inside face (other face); 5 photoelectric conversion layer; 6 optically-transparent electroconductive layer; 6*a* edge portion; 7 contact portion.

The invention claimed is:

1. A transmission mode photocathode comprising:

an optically transparent substrate having one face to which light is incident, and another face from which the light incident to the one face is output;

a photoelectric conversion layer disposed on the other face side of the optically transparent substrate and configured to convert the light output from the other face into a photoelectron or photoelectrons; and an optically-transparent electroconductive layer comprising graphene, and disposed between the optically transparent substrate and the photoelectric conversion layer; wherein the optically-transparent electroconductive layer covers a region through which the light is transmitted when viewed from a thickness direction of the optically transparent substrate, and the photoelectric conversion layer covers a portion of the optically-transparent electroconductive layer overlapping the region.

2. The transmission mode photocathode according to claim 1, wherein the optically-transparent electroconductive layer is comprised of a single layer of graphene.

3. The transmission mode photocathode according to claim 1, wherein the optically-transparent electroconductive layer is comprised of multiple layers of graphene.

4. The transmission mode photocathode according to claim 1, wherein the photoelectric conversion layer covers the whole of the optically-transparent electroconductive layer when viewed from the thickness direction.

5. The transmission mode photocathode according to claim 1, wherein the optically-transparent electroconductive layer contacts the other surface of the optically transparent substrate.

6. The transmission mode photocathode according to claim 1, wherein the photoelectric conversion layer forms a photoelectric surface consisting primarily of an alkali metal.

7. A transmission mode photocathode comprising:

an optically transparent substrate having one face to which light is incident, and another face from which the light incident to the one face is output;

a photoelectric conversion layer disposed on the other face side of the optically transparent substrate and configured to convert the light output from the other face into a photoelectron or photoelectrons; and an optically-transparent electroconductive layer comprising graphene, and disposed between the optically transparent substrate and the photoelectric conversion layer; wherein the optically-transparent electroconductive layer contacts the other surface of the optically transparent substrate, and the photoelectric conversion layer forms a photoelectric surface consisting primarily of an alkali metal.

8. The transmission mode photocathode according to claim 7, wherein the photoelectric conversion layer covers the whole of the optically-transparent electroconductive layer when viewed from a thickness direction of the optically transparent substrate.

9. The transmission mode photocathode according to claim 7, wherein the optically-transparent electroconductive layer is comprised of a single layer of graphene.

10. The transmission mode photocathode according to claim 7, wherein the optically-transparent electroconductive layer is comprised of multiple layers of graphene.

11. An electron tube comprising a hermetic vessel, the hermetic vessel including an optically transparent substrate having one face to which light is incident and another face from which the light incident to the one face is output, and a side tube to which the optically transparent substrate is fixed; the electron tube further comprising:

a photoelectric conversion layer disposed on the other face side of the optically transparent substrate and configured to convert the light output from the other face into a photoelectron or photoelectrons;

an optically-transparent electroconductive layer comprising graphene, and disposed between the optically transparent substrate and the photoelectric conversion layer; and an contact portion contacting the side tube and the optically-transparent electroconductive layer; wherein the photoelectric conversion layer covers at least a part of the side tube, the optically-transparent electroconductive layer, and the contact portion when viewed from a thickness direction of the optically transparent substrate.

12. The electron tube according to claim 11, wherein the side tube comprises a metal.

13. The electron tube according to claim 11, wherein the side tube has a flange portion fixed to the other face of the optically transparent substrate, and the photoelectric conversion layer covers at least a part of the flange portion when viewed from the thickness direction.

14. The electron tube according to claim 11, wherein the optically-transparent electroconductive layer contacts the other surface of the optically transparent substrate.

15. The electron tube according to claim 11, wherein the photoelectric conversion layer forms a photoelectric surface consisting primarily of an alkali metal.

16. The electron tube according to claim 11, wherein the photoelectric conversion layer covers the whole of the optically-transparent electroconductive layer when viewed from the thickness direction.

17. The electron tube according to claim 11, wherein the optically-transparent electroconductive layer is comprised of a single layer of graphene.

18. The electron tube according to claim 11, wherein the optically-transparent electroconductive layer is comprised of multiple layers of graphene.

* * * * *